United States Patent [19]

Slathar et al.

[11] 3,956,869

[45] May 18, 1976

[54] CARTONING APPARATUS WITH UNDERCOUNT MEMORY MEANS

[75] Inventors: Donald A. Slathar, Chanhassen; Christiaan H. Neutkens, Cottage Grove, both of Minn.

[73] Assignee: International Telephone and Telegraph Corporation, Nutley, N.J.

[22] Filed: Apr. 14, 1975

[21] Appl. No.: 567,905

[52] U.S. Cl. ..... 53/53; 53/240

[51] Int. Cl.[2] ..... B65B 57/10

[58] Field of Search ..... 53/53, 54, 237, 240

[56] References Cited

UNITED STATES PATENTS

| | | | |
|---|---|---|---|
| 2,976,659 | 3/1961 | Flanagan et al. | 53/237 |
| 3,674,140 | 7/1972 | File | 53/53 X |
| 3,731,451 | 5/1973 | Sexstone et al. | 53/53 X |

*Primary Examiner*—Travis S. McGehee
*Attorney, Agent, or Firm*—John T. O'Halloran; Menotti J. Lombardi, Jr.

[57] ABSTRACT

A cartoning machine having means for depositing three items into a carton as it is conveyed past each of a predetermined number of depositing points. Means are provided for determining when an undercount for a carton occurs and for rejecting the undercount carton.

20 Claims, 6 Drawing Figures

39
41
37
41a
35
36
64
67
71
71
83
87
81
77
79
89
85
75
91
66
27
19
29
31
30
25
21
23
17
73
73a
73b
73c
73h
73g
73d
74
73f
73e
15
11
13
89a
89
89c
89b
75
77c
64
77bc
77b
80
81
78
77a
77ac
79
64

CARTONING APPARATUS WITH UNDERCOUNT MEMORY MEANS

Background of the Invention

In general, this invention relates to cartoning machines and more particularly, to an item count cartoning apparatus with an undercount memory system.

The cartoning and item handling apparatus to which this invention is particularly concerned, are mint patties of the small variety which individually retail for about three cents an item. These items are individually wrapped and loosely packed in a carton. Normally, these small individually wrapped mint patties are sold by the carton and contain a sixty item count. It is important in view of the high ingredient costs that the count be accurate per carton so that there is no overage, and it is equally important that no carton contains an undercount.

Certain prior art systems include weighing arrangements which determine the count by a predetermined weight range; these systems have not met the desired accuracy, and do entail a large investment. Other suggested arrangements include complex electronic circuits including photodetectors, memory and counting electronics which store and indicate overage and underage counts. These electronic systems are complex, expensive and require constant operator monitoring, and maintenance is costly.

Accordingly, it was determined to overcome these previous systems and develop an item count cartoning machine with an undercount memory system which would be rugged and simple to maintain, yet having the features of an electronic shift register. The mechanical memory system would retain the indication of a shortage in a particular carton and reject the carton automatically from the line.

Summary of the Invention

An object of the invention is to provide an improved automatic cartoning apparatus.

Another object of the invention is to provide an improved item count cartoning apparatus with memory means.

A further object of the invention is to provide an item count cartoning machine with an undercount memory system.

According to the invention, a 60 item count cartoning machine is configured to operate as follows. The cartons are deposited on a conveying belt and wrapped products from vibrating plates are fed in 20 lanes into the cartons. Depositing wheels deposit three patties from each lane into the carton as it passes each lane in a timed and progressive manner. After each carton is properly filled, it is transferred to a closing station.

However, according to the invention, an undercount in any carton will be rejected by the following operation. When the wheels are dropping wrapped patties, each patty falls through and activates a reciprocating gate and ball striker. A steel ball cage rotates in timed relationship with the depositing wheels. The cage consists of three discs equally spaced which contain six steel balls with the center disc having six ball displacement holes. The balls are retained loosely in the holes between center and outer discs. The striker when activated by a patty, moves between discs displacing a ball through the hole to the other side. Each displaced ball is returned by a ball return plow after the shaft rotates about three-fourths of a revolution. When at any time there is no patty deposited, the ball is not displaced and as it moves to the top portion of the cage, a pushrod is actuated which, in turn, moves a lever and drops a flag identifier which represents the carton in which the undercount took place. Both carton and flag identifier proceed until the dropped flag identifier actuates a microswitch which, in turn, opens a solenoid operated gate to cause rejection of the respective carton.

Brief Description of the Drawings

The foregoing objects and features of the invention will best be understood if reference is made to the following description in connection with the drawings, in which.

Description of the Preferred Embodiment

Figures 1A, 2, 3A:
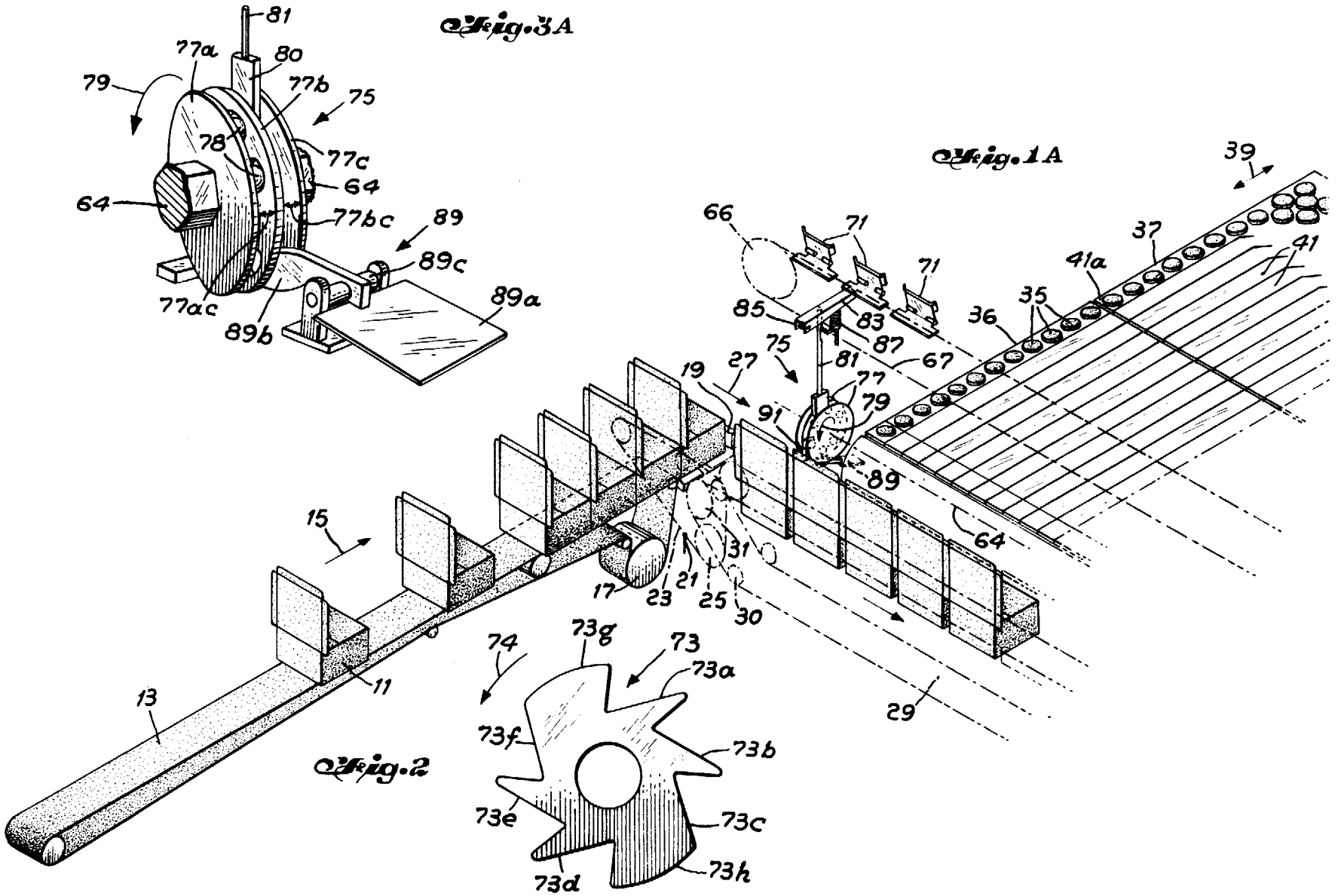
FIGS. 1A and 1B comprise an isometrical operational drawing showing the cartoning apparatus with the undercount memory means.
FIG. 2 is a detailed and enlarged view of a depositing wheel.
FIG. 3A is an enlarged frontal view of a portion of the memory means according to the invention.
Figures 1B, 3B, 4:
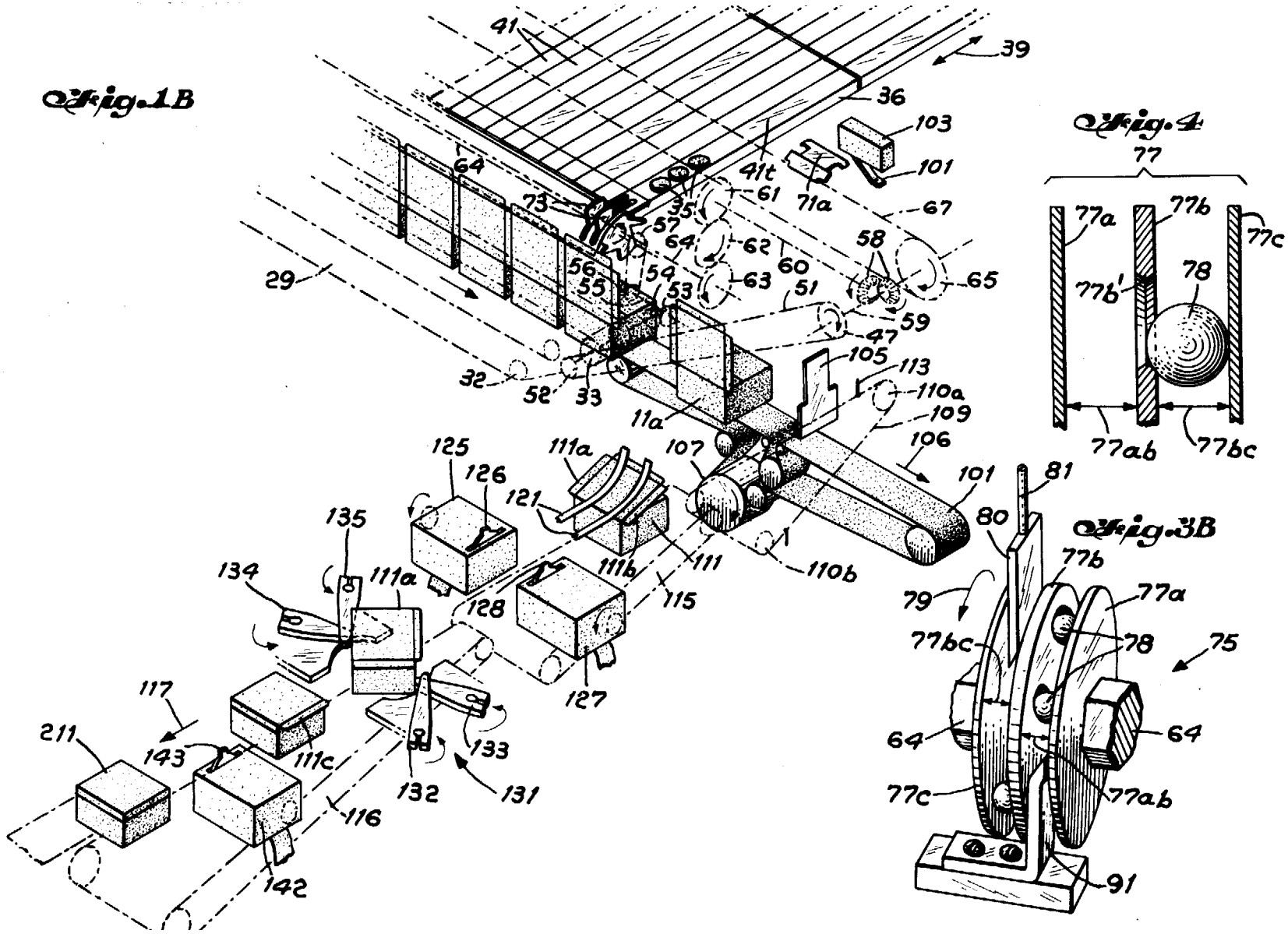
FIG. 3B is an enlarged partial view of the reverse side of the memory means shown in FIG. 3A.
FIG. 4 is a partial enlargement illustrating the ball cage utilized in the memory system according to the invention.

Referring jointly to FIGS. 1A and 1B, a 60 item count cartoning machine is illustrated in an isometric operational drawing. The cartons 11 are deposited on an infeed belt 13 mounted about a plurality of pulleys and moved in the direction of arrow 15 by means of drive belt pulley 17. The infeed belt 13 is also mounted about pulleys 12*a*, 12*b*, 12*c*, the other pulleys as illustrated. The moving infeed belt 13 carries the cartons 11 to the stop rail 19 at which point they are engaged by one of the lugs 21 on lug chain 23 which is mounted in a transverse direction to conveyor 13 by three pulleys 25. At least one of the pulleys 25 is driven and propels the cartons 11 in the direction of arrows 27 and onto the looped conveyor 29 illustrated in phantom lines. The conveyor 29 is mounted about drive rollers 30, 31, 32, 33, and drive roller 33 is driven from a common drive source.

The wrapped mint products 35 are fed by two vibrating plates 36, 37 vibrating in the direction of arrows 39 into twenty lanes 41*a*–41*t*. Each one of the twenty lanes illustrated includes a counting means in line with lane 41*a*, and a pair of depositing wheels to pick up the wrapped mints shown in line with lane 41*t*. The depositing wheels dropped the mints onto the counting means and through to the carton as hereinafter described.

From drive gear 47 schematically illustrated in dash lines, the other drives, to be hereinafter described, are in geared and predetermined time relationship to enable continuous movement of the cartons and depositing of the mint products in each carton in a continuous manner. The sprocket 47 is driven by 33 roller shaft represented by dashed line 51 to sprocket 52 which in turn drives right angle gears 53, 54. Gear 54 is coupled to drive sprocket 33 to control movement of conveyor 29. Gear 53 is also coupled by shaft 55 to gears 56, 57 to control the movement and timing of depositing wheels 73 mounted on a common shaft and driven by gear 57.

Gear 47 is coupled by shaft 59 to right angle gears 58 hich are coupled by shaft 60 to gears 61, 62, 63. Gear 3 is mounted on shaft 64 to control and drive memory ıeans 75 also mounted on shaft 64. Shaft 59 is coupled › drive pulley 65, and chain link 67 which is driven in closed loop about pulleys 65, 66. Mounted on chain 7 and moving in a continuous loop are a plurality of ltably mounted flags 71 in a predetermined spaced ·lationship. The flag is L-shaped and shown in an pright position in FIG. 1A, and is illustrated in FIG. B in its tilted or activated position 71*a*. The flags are lways returned to the upright position during the reırn loop from pulley 65 to 66. As illustrated in lane 1*t*, each lane of the vibrating feeder table 36 includes vo depositing wheels 73 for engaging the wrapped ıints 35. The wheels drop three mints in succession nto a striker which moves and allows the mints to drop ıto cartons being conveyed in the direction of arrow 7.

Referring to FIG. 2, an enlarged view of one of the airs of depositing wheels 73 is illustrated. The wheel 3 has six engaging teeth surfaces 73*a* through *f*. Each aid surface of the wheel engages a mint 35 and dislaces them onto the striker plate while the wheel roates in the direction of arrow 74. The surfaces indiated as 73*g* and *h* are to compensate for the spacing etween the cartons 11, so that three consecutive enaging teeth 73*a* through *c* will engage three consecuive mints 35 and deposit them so they fall into a first noving carton, and the following three engaging teeth '3*d* through *f* will engage the following three mints 35 nd drop them in the following carton.

Referring back now to FIGS. 1A and 1B, the wheels '3 are shown only at one of the lanes 41, whereas there ıre twenty pairs, one in each lane. In the same manner, he memory means 75 is juxtaposed, each pair of vheels 73 to be responsive to each mint deposited by he wheels 73 in all the twenty lanes 41. Each of the nemory means 75 includes the following elements. A teel ball cage 77 rotates in the direction of arrow 79 on haft 64. A pushrod 81 is activated when moved by a teel ball in the cage which has not been displaced by a leposited mint. A trip lever 83 responsive to rod 81 is ›ivotally mounted at one end 85 and retained in an ınactivated position by spring 87. A ball striker 89 is ıctivated by each deposited mint and a return ball plow 91 resets the balls. In operation, the wheels 73 engage ı mint 35 and drop it onto the ball striker 89 which in urn is pivotally mounted in the middle, and the other end of the ball striker pushes a ball from one side of the teel ball cage to the other side of the steel ball cage. If ı mint is not dropped onto the striker plate, then the ball will not be displaced in the cage and will activate pushrod 81 which will trip a flag 71. The carton corresponding to the tripped flag has an undercount and when it reaches a position on conveyor belt 101, it will be rejected from the finishing line in the following manner.

Carton 11*a* is indicated as having an undercount because the associated flag 71*a* is in a tripped or down position as shown. The flag 71*a* will activate lever 101 of microswitch 103 to cause a solenoid operated gate 105 to be lifted out of the vertical position and permit carton 11*a* to move in the direction of arrow 106. Thereby, the carton 11*a* will be rejected as an undercount carton and removed from conveyor 101. If three mints from each of the 20 feeding lines are deposited in the cartons, then the flags 71 are not tripped but are retained in the up position as indicated by flags 71. If microswitch 103 is not activated by a tripped flag, then conveyor 101 mounted in a continuous loop about pulleys and driven by pulley drive 107 conveys the filled cartons against the unoperated gate 105. A lug chain 109 mounted in a loop about pulleys 110*a, b, c* engages by means of a lug 113 a carton and transfers the carton to conveyor 115.

The conveyor 115 carries a full carton 111 to be closed past folding guides 121 to lower the lid. Glue pots 125, 127 have rotating tabs 126, 128 which periodically are inserted into the hot melt and then engage the tabs 111*a*, 111*b*. The tabs may be sealed to the carton manually or with another set of side folding guides such as 121. Conveyor 116 moves the carton 111 to a turning station 131. The turning station comprises four turning elements 132, 133, 134, 135, each of the elements rotated in the direction of its associated arrow about a vertical shaft. This rotation of the elements and movement of the conveyor in the direction of arrow 117 causes a 90° turn of the carton 111, so that the remaining tab 111*c* engages tab 143 of glue pot 142 as it moves on output conveyor 116. The remaining tab 111*c* is then folded to produce a finished carton 211 by another folding guide or manual means.

The operation just described includes conveying empty cartons past twenty stations, each station depositing three mints. A memory means is provided so that if any station fails to drop three mints in a carton, a flag indicator corresponding to the carton having an undercount activates a microswitch and rejects said carton.

The operation of the memory means will be further described in connection with FIGS. 3A, 3B, and FIG. 4 which are enlarged perspective views of pertinent elements of the undercount memory means. Each station includes a memory means 75 including a steel cage 77 having three disc parts 77*a*, 77*b* and 77*c* mounted to rotate with shaft 64 in the direction indicated by arrow 79. As illustrated in FIG. 4, each center disc 77*b* includes six holes such as 77*b'* to enable respective ones of the six steel balls 78 to be displaced from one space 77*bc* formed by discs 77*b* and 77*c* to the other space 77*ab* formed by discs 77*a* and 77*b*. This displacement is caused by the pivotally mounted ball striker 89. The ball striker 89 includes a flat gate member 89*a* and a striker member 89*b* pivotally mounted by means 89*c*. Each mint when displaced by wheel 73 will be dropped onto flat gate member 89 to cause striker member 89*b* to pivot upward and push a ball 78 positioned in space 77*bc* to opposite space 77*ab*. If a ball is not displaced due to the failure to drop a mint, then the ball will be retained in space 77*bc* and during the course of rotation of the cage 77 in the direction of arrow 79, the undisplaced ball will engage pushrod 81 at its lower member 80. Member 80 is positioned between plates 77*b* and 77*c* to cause tripping of the associated flag for the carton missing a mint. If each ball has been displaced properly, then the pushrod 81 will not be activated and the flag will not be tripped.

All the balls which have been displaced into space 77*ab* must be returned to space 77*bc* for a following six mint cycle. This is accomplished, see FIG. 3*b*, by a return plow 91 which channels the balls 78 through their corresponding hole to the opposite space. In sequence, each ball 78 is either displaced by a dropping of the mint or it activates the trip lever 81. If a ball has been displaced, then it is recycled by means of return plow 91 in sequence during rotation of the steel cage 75 in the direction of arrow 79. In this sequential manner, each carton in each channel displaces three balls and the following carton in the same channel displaces the subsequent three balls which are spaced around the steel cage in a manner corresponding as the wheel 73 of FIG. 2. The balls 78 and the wheel surfaces 73*a–f* occupy the same relative position. Each deposit of a mint onto a striker plate 89*a* by a wheel surface 73*a* through *f* will cause displacement of an associated ball 78 in the cage to insure a proper count in each of the cartons passing the depositing station.

In summary, a 60 count cartoning machine was described and the cartons to be filled are deposited on an infeed belt and conveyed into the machine. The cartons stop against the rail and are picked up by a lug chain to a right angle turn. Wrapped mint products are fed in 20 lanes by vibrating plates. Depositing wheels are positioned to drop three mint patties from each lane into the carton as it passes each lane. After the carton is filled, it is transferred on another conveyor and stops against solenoid operated gate where it is picked up by a lug chain and moved to closing station. The lid is folded and two flaps are glued whereafter it stops momentarily and carton turns 90° by rotary arms after which the last flap is glued and the carton sealed.

The unique memory means operates to reject any carton having an undercount. Each mint is dropped to fall through a reciprocating gate member. A steel ball cage rotates in correspondence to the depositing wheels and the cage consists of three discs equally spaced and containing the steel balls with the center disc having six holes. The balls are locked loosely into holes between a center and an outer disc. The striker then moves between discs displacing balls through the holes to the other side and are returned by a ball return plow, after shaft rotates approximately 260°. When at any time there is no product dropped, the balls are not displaced and as they move to the top, a pushrod is actuated, which in turn moves a lever and drops a flag representing the carton in which the undercount took place. The carton and flag proceed so that the dropped flag will actuate a microswitch, which in turn opens the solenoid operated gate, rejecting the respective carton.

While we have described above the principles of our invention in connection with specific apparatus, it is to be clearly understood that this description is made only by way of example and not as a limitation to the scope of our invention as set forth in the objects thereof and in the accompanying claims.

We claim:

1. Cartoning apparatus with an undercount memory means comprising:

means for feeding individual items for cartoning in a plurality of lanes;

means for conveying cartons to be filled with said items past the terminal of said plurality of lanes;

each said lane terminal including depositing means for engaging and depositing a predetermined number of items into each passing carton, and memory means responsive to each item deposited by said depositing means; and indicating means associated with each carton and actuated by a memory means whenever an undercount in the predetermined number occurs.

2. The apparatus of claim 1 wherein said means for feeding includes vibrating plates for feeding said items in a plurality of lanes forward to the depositing means.

3. The apparatus of claim 1 wherein said conveying means includes an infeed conveyor, and means for turning and conveying said cartons from said infeed conveyor past the terminal of said plurality of lanes.

4. The apparatus of claim 3 including means for conveying said cartons to a rejection station, and means for conveying unrejected cartons to a finishing station.

5. The apparatus of claim 4 including means for folding said cartons and applying glue to said cartons for sealing said cartons having a predetermined item count.

6. The apparatus of claim 5 including means for turning said carton 90°.

7. The apparatus of claim 6 wherein said turning means includes first and second pairs of turning arms, said first pair turning in a first direction and engaging said carton, and said second pair turning in a second opposite direction and engaging said carton.

8. The apparatus of claim 1 wherein said depositing means includes a pair of star shaped wheels rotating in unison and having six spaced engaging and depositing surfaces.

9. The apparatus of claim 8 including means for mounting each pair of wheels for each lane on a common shaft, and means for driving said shaft in a predetermined speed relative to said conveying means.

10. The apparatus of claim 1 wherein said memory means includes a ball cage rotatably mounted, said ball cage comprising three discs equally spaced and containing a plurality of balls, and the center disc having a plurality of holes for loosely locking said balls between said center disc and an outer disc.

11. The apparatus of claim 10 including a reciprocating gate member and ball striker positioned to move between said center and said outer disc to displace said balls through an associated one of said holes to loosely lock said balls between said center disc and the other one of said outer discs.

12. The apparatus of claim 11 including a ball return plow to return said displaced balls to the space defined by said center and said outer disc.

13. The apparatus of claim 12 including a pushrod means positioned between said center disc and said outer disc and actuated by an undisplaced ball.

14. The apparatus of claim 13 including a trip lever pivotally mounted and actuated by said pushrod to trip said indicating means.

15. The apparatus of claim 1 wherein said indicating means includes an L-shaped flag mounted and moving in a continuous loop, one flag for each carton.

16. The apparatus of claim 15 including means responsive to an actuated indicating means for rejecting the associated carton.

17. The apparatus of claim 16, said responsive means including a switch and a gate operated by said switch to cause said associated carton to be rejected.

18. Mint cartoning apparatus with undercount memory means comprising in combination:

vibrating plates for feeding the mints in a plurality of lanes for deposit into cartons;

means for conveying the cartons along said plurality of lanes to receive said mints;

each said lane further including means for engaging and depositing a predetermined number of mints into each passing carton, and means responsive to each mint deposited from said lane; and means associated to each carton and actuated by said responsive means to cause rejection of each carton lacking the predetermined number of mints.

19. The apparatus of claim 18 wherein said responsive means includes a ball cage rotatably mounted, said ball cage comprising three discs equally spaced and containing a plurality of balls, the center disc having a plurality of holes for loosely locking said balls between said center disc and an outer disc, a reciprocating gate member and ball striker positioned to move between said center and said outer disc to displace said balls through an associated one of said holes to loosely lock said balls between said center disc and the other one of said outer discs, a ball return plow to return said displaced balls to the space defined by said center and outer disc, a pushrod means positioned between said center disc and said outer disc and actuated by an undisplaced ball, and a trip lever pivotally mounted and actuated by said pushrod to trip said associated means.

20. The apparatus of claim 19 wherein said associated means includes an L-shaped flag mounted and moving in a continuous loop, one flag for each carton, a switch operated by a tripped flag, and a gate operated by said switch to cause said carton to be rejected.

* * * * *